US006569285B2

(12) United States Patent
Bryant et al.

(10) Patent No.: US 6,569,285 B2
(45) Date of Patent: May 27, 2003

(54) PROCESS FOR GAS PHASE PRETREATING OF LIGNOCELLULOSIC CONTAINING MATERIAL

(75) Inventors: Patrick S. Bryant, Woodstock, GA (US); John C. Sokol, Kennesaw, GA (US)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/798,844

(22) Filed: Mar. 2, 2001

(65) Prior Publication Data

US 2002/0088573 A1 Jul. 11, 2002

Related U.S. Application Data

(63) Continuation of application No. 09/501,384, filed on Feb. 9, 2000, now abandoned.

(51) Int. Cl.[7] ..... D21C 9/14

(52) U.S. Cl. ..... 162/67; 162/63; 162/66

(58) Field of Search ..... 162/63, 65, 66, 162/67

(56) References Cited

U.S. PATENT DOCUMENTS

| | | | | | |
|---|---|---|---|---|---|
| 3,591,451 | A | * | 7/1971 | Wilder | 162/67 |
| 3,919,041 | A | | 11/1975 | Wilder | 162/25 |
| 4,172,006 | A | * | 10/1979 | San Clemente | 162/65 |
| 4,622,100 | A | * | 11/1986 | Godsay et al. | 162/65 |
| 4,770,868 | A | | 9/1988 | Norell | 423/479 |
| 4,869,783 | A | | 9/1989 | Prusas et al. | 162/18 |
| 5,091,166 | A | | 2/1992 | Engstrom et al. | 423/478 |
| 5,091,197 | A | | 2/1992 | Ferro et al. | 426/80 |
| 5,380,517 | A | | 1/1995 | Sokol | 423/478 |
| 5,474,654 | A | * | 12/1995 | Mendiratta et al. | 162/53 |

FOREIGN PATENT DOCUMENTS

| | | | | |
|---|---|---|---|---|
| DE | 1 049 220 | | 1/1959 | |
| GB | 567774 | | 3/1945 | |
| JP | 0067923 | * | 12/1976 | |
| SE | 454 185 B | | 4/1988 | D21B/1/02 |
| WO | 89 08165 | | 9/1989 | D21C/1/04 |
| WO | WO 91/19040 | | 12/1991 | D21B/1/02 |

OTHER PUBLICATIONS

*Kirk–Othmer, Encyclopedia of Chemical Technology*, vol. 20, 4th Ed., p. 535.

*Rydholm, Pulping Processes, Interscience Publisher*, p. 284.

*Ullman's Encyclopedia of Industrial Chemistry*, vol. A18, 5th Ed., 1991, pp. 568–569.

*Derwent No. 197–44761V* [24] *Abstract of Japan Patent 49020241B*, May 23, 1974.

*Derwent No. 1989–059880* [08] *Abstract of Soviet Union Patent 1416576A*, Aug. 15, 1988.

European Search Report EP 00 85 0037.

* cited by examiner

*Primary Examiner*—Dean T. Nguyen

(74) *Attorney, Agent, or Firm*—Lainie E. Parker; Michelle J. Burke

(57) ABSTRACT

The present invention relates to a process for the removal of lignin from lignocellulose containing material comprising treating the lignocellulose containing material prior to a chemical pulping process with a delignifying gas, wherein the gas comprises chlorine dioxide.

11 Claims, No Drawings

PROCESS FOR GAS PHASE PRETREATING OF LIGNOCELLULOSIC CONTAINING MATERIAL

This application is a continuation of application Ser. No. 09/501,384, filed Feb. 9, 2000 now abandoned.

FIELD OF THE INVENTION

The present invention relates to a process for the removal of lignin from lignocellulose containing material comprising treating the lignocellulose containing material prior to a chemical pulping process with a delignifying gas, wherein the gas comprises chlorine dioxide.

BACKGROUND OF THE INVENTION

In chemical pulping processes the objective is to remove the lignin present in lignocellulose containing material while minimising the damage and loss of the cellulose and hemicellulose fibres. In these processes, often also referred to as cooking or digestion processes, the lignocellulose containing material reacts with pulping chemicals at an elevated temperature over a time period sufficient to effect a specified degree of delignification. As such, the digestion process is a complex kinetic balance relating delignification to inter alia the cooking chemical(s), time and temperature. These variables are balanced to produce a pulp with the highest strength, greatest yield and the lowest lignin content.

In chemical pulping processes, pulping chemicals are introduced into the digester along with the lignocellulose containing material and subsequently heated to a specific digestion temperature for a predetermined period of time. As the digestion proceeds the chemical concentration, temperature and digestion time all effect the removal of the lignin from the lignocellulose containing material.

However, as the chemical concentration increases there is more of a tendency for chemical attack on the cellulose and hemicellulose fibres instead of the lignin. The chemicals react with the carbohydrates and break or cleave the fibre chains resulting in shorter polymer lengths and overall lower fibre strength, i.e. impaired viscosity. This effect is further increased as the temperature and reaction time increase. Consequently, more cellulosic material is present in the pulping liquor. When the spent pulping liquor is removed from the pulp in the post-washing step, these materials are lost resulting in lower pulp yields.)

Side reactions in the cooking process are very temperature dependent. Lignin removal proceeds slowly at first but accelerates markedly as the temperature rises above 160° C. Cellulose removal starts at 120–130° C. and levels off when the maximum temperature is reached. Hemicellulose is composed of two main components, glucomannan and xylan. Glucomannan removal is rapid at first and becomes even greater as the temperature increases above 100° C. Xylan on the other hand follows the same pattern as lignin removal starting slowly at first and increasing rapidly as the temperature increases.

The rate of penetration and diffusion of the pulping chemicals into the fibre source determines the efficiency of the digestion. A too short digestion time results in non-uniform cooking and a poor pulp product, while excessive digestion generates overcooked pulps with poor viscosity.

From the above it can be seen that changes within the digestion process to increase lignin removal usually have a negative impact on the product pulp properties. Higher chemical concentrations and/or temperature result in lower strength and yield. Longer digestion times reduce the throughput through the digester and lower the pulp production.

To achieve a given degree of delignification, various combinations of heat-up time, maximum temperature and time at the maximum temperature can be used. To simplify comparisons of different cooking conditions, the pulp and paper industry has developed the H-factor. This value is the sum of the relative rates of reaction occurring in the digestion. For a closer definition of the H-factor we refer to Kirk-Othmer, Encyclopedia of Chemical Technology, Vol. 20, $4^{th}$ Ed., p. 535 which is hereby incorporated by reference. Using the H-factor and the kappa number after the cook, different treatment and cooking processes can be compared on an equivalent basis. For example, reducing the H-factor for the process would allow for shorter cooking/digesting times and increase pulp production in existing equipment or allow the digestion to be accomplished at a lower temperature resulting in improved yield and strength properties.

Thus, from the reasons set out above it is preferable to pretreat the lignocellulose containing material in such a way as to facilitate the removal of lignin in a subsequent pulping process and/or break and softer the lignin bonded to the cellulose and hemicellulose fibres.

If the pulping process is a chemical pulping process the H-factor can be significantly reduced when preterating the lignocellulose containing material according to the invention.

U.S. Pat. No. 4,172,006 refers to the pretreatment of wood chips with oxygen prior to adding a cooking liquor.

U.S. Pat. No. 4,750,973 relates to a process for reducing carbohydrate losses in sulphate pulping of wood using sodium hydroxides and sodium sulfide, wherein the wood is pretreated in presence of water with oxygen gas and nitrogen oxides.

GB 567774 discloses a process for the treatment of cellulosic raw material where wood chips are contacted with a aqueous solution of a wetting agent prior to subjecting the chips to a solution containing sodium chlorite thereby using sufficient acid to insure the liberation of chlorine dioxide.

WO 8908165 refers to a method for the pretreatment of wood chips with sulphur dioxide gas prior to alkaline deligification operations.

DE 1049220 discloses a method comprising subjecting wood chips to carbon acid before sulfite cooking.

JP 49020241 refers to a pulping process comprising the steps of reacting chlorine dioxide or a mixture consisting of chlorine dioxide and chlorine with wood chips in the presence of water soluble cellulose derivatives and thereafter removing inter alia the oxidised lignin by extraction.

U.S. Pat. No. 5,474,654 refers to a delignification process where chlorine dioxide gas is used on pulp obtained from pulping processes such as chemical kraft, sulfide or mechanical processes.

U.S. Pat. Nos. 3,591,451 and 3,919,041 disclose the use of gaseous chlorine dioxide subsequent a pretreatment step which may be either mechanical, chemical or a combination thereof.

SUMMARY OF THE INVENTION

In accordance with the present invention it has surprisingly been found that the lignin content of lignocellulose containing material can be reduced prior to a chemical pulping processes by providing a process according to the claims. More specifically, the invention relates to a process for the removal of lignin from lignocellulose containing material, where the material prior to a chemical pulping process is treated with a delignifying gas comprising chlorine dioxide.

DETAILED DESCRIPTION OF THE INVENTION

An advantage by treating lignocellulose containing material prior to a pulping process in accordance with the present invention is that the pulp yield and pulp properties such as pulp viscosity subsequent a pulping process are significantly improved at given (corresponding) H-factors.

Thus, by implementing the present invention in an existing pulping process, improved pulp yield and pulp viscosity is obtained at corresponding Kappa numbers.

Another advantage is that effluent streams originating from the pulping process are reduced since in-specific properties such as pulp yield and viscosity can be obtained at decreased pulping chemical dosages (lower H-factors of the cooking operation can be used).

A still further advantage of the present invention is that by pretreating cellulose containing material prior to a chemical pulping process with chlorine dioxide or any gas comprising chlorine dioxide the lignin content of the pulp (expressed by the kappa number) dramatically decreases after chemical pulping processes having similar H factors while not significantly impairing the viscosity over pretreatments where oxidising gases other than chlorine dioxide have been used.

Further advantages of the present invention are apparent from the specification.

Suitable lignocellulose containing material used in the present invention can be any lignocellulose containing material derived from natural sources such as softwood, hardwood, gum, straw, bagasse and/or bamboo. The physical state of the lignocellulose containing material is not critical, however, a physical state providing a large surface area is preferred that maximises penetration of the delignifying gas and optionally processing chemicals. Suitably, the lignocellulose containing material is in the form of chips with a size which is governed by the process equipment and process parameters.

The lignocellulose containing material is suitably treated according to any method known to the skilled artisan which renders the diffusion of the delignifying gas within the fibre source to the lignin more effective such as steaming and/or evacuation.

According to the present invention the lignocellulosic material is treated with a gas comprising chlorine dioxide such as gaseous chlorine dioxide. Suitably, the delignifying gas mixture comprising chlorine dioxide is a non-liquid containing gas. The chlorine dioxide containing gas may contain other gases such as nitrogen, oxygen, air or steam or mixtures thereof. The chlorine dioxide containing gas may also contain small amounts of chlorine, however, the gas is suitably substantially free from chlorine, preferably having less than 10% by volume, more preferably less than 1% by volume of chlorine. The concentration of chlorine dioxide in the gas is not critical for the invention. Thus, the lignocellulose containing material may be treated with substantially pure chlorine dioxide gas. The upper limit of the amount of chorine dioxide comprised in the gas mixture is purely set by safety considerations. Suitable concentrations of chlorine dioxide comprised in the gas mixture are from about 0.05 up to about 100% by volume, more preferably from about 0.05 up to about 50% by volume and most preferably from about 1 up to about 20% by volume.

The delignifying gas containing chlorine dioxide is believed to selectively attack the lignin leaving the majority of the cellulose and hemicellulose fibres intact. The pre-removal of the lignin allows conditions to be optimised in the cooking process in terms of pulp yield, strength and production rate.

The use of a delignifying gas comprising chlorine dioxide overcomes several unsolved problems. Treatment of the lignocellulosic containing material with solutions containing for example chlorine dioxide is limited by the rate of chlorine dioxide diffusion through the solution to the fibre source followed by the diffusion of the chlorine dioxide within the fibre source to the lignin. The result is a slow delignification process that works primarily on the fibre source surface and an aqueous effluent stream containing chlorine dioxide, dissolved fibre components and chlorides, which is difficult to treat in an environmentally correct manner.

It has been found that a gas comprising chlorine dioxide does not have the diffusion barriers that limit the process when a solution is used. The gas passes rapidly and uniformly into the fibre source resulting in even delignification throughout the material. Furthermore, there are no aqueous effluent streams. The degraded lignin and lignin by-products are carried with the lignocellulose containing material into the digestion process where additional delignification occurs. The total dissolved lignin is then removed in the normal washing step following the cooking process.

Preferably, the gas comprising chlorine dioxide is applied on lignocellulose containing material free from any surrounding aqueous solution. Preferably, the moisture content of the lignocellulose containing material is from about 30 weight % up to about 60 weight % based on oven dry material, more preferably from about 40 up to about 50 weight %.

The chlorine dioxide containing gas employed in the present invention is suitably produced using a chlorine dioxide generation process as described in the US patens U.S. Pat. Nos. 4,770,868, 5,091,166, 5,091,197 and 5,380,517, which all are incorporated by reference.

The gas comprising chlorine dioxide is generally applied in amounts which are suitable for removal of lignin to a desired degree. Usually, increased applied amount of chlorine dioxide comprised in the gas (mixture) increases the degree of delignification. The charge of chlorine dioxide is from about 0.5 kg/tonne up to about 300 kg active $Cl_2$ per tonne of oven dry material, more preferably from about 2 kg up to about 100 kg active $Cl_2$ per tonne oven dry material and most preferably from about 30 kg/tonne up to about 50 kg active $Cl_2$ per tonne oven dry material.

The present invention may be performed at any location prior to chemical pulping processes. The lignocellulose containing material may be treated with the gas comprising chlorine dioxide in any type of equipment. For practical reasons the equipment should be gas tight. The treatment with the gas comprising chlorine dioxide may also be carried out in the same equipment (vessel) as is used for the subsequent pulping process.

Suitably, the treatment is carried out in an equipment such as a vessel which is essentially free from an aqueous solution, i.e. the treatment is carried out in the absence of aqueous solutions. By essentially free from an aqueous solution is meant that a minor amount aqueous solution can be present during the treatment with a gas comprising chlorine dioxide as long as the removal efficiency of lignin is not significantly impaired, i.e. as long as the overall diffusion (diffusion of the gas in respect of the totality of material treated) of the gas containing chlorine dioxide to the lignocellulose containing material is not significantly impaired.

The delignifying gas is suitably admixed with the lignocellulose containing material in an equipment which is at any suitable pressure including atmospheric, subatmospheric or superatmospheric pressures. Suitably, the treatment with the delignifying gas is carried out at a pressure ranging from about 10 kPa up to about 500 kPa, preferably from about 50 kPa up to about 250 kPa. The most preferred pressure ranges from about 80 kPa up to about 120 kPa.

The temperature during the treatment according to the present invention is not critical and can be carried out at surprisingly low temperatures including ambient temperatures. The upper temperature level in the treatment is set by economical and safety considerations. Temperatures may range from about 10° C. up to about 400° C., suitably from about 15° C. up to about 200° C., more preferably from about 20° C. up to about 95° C. and most preferably from about 25° C. up to about 90° C. Suitable temperature ranges are also those obtained by combining any of the lower temperature level of above ranges with any of the higher temperature levels.

According to one preferred embodiment of the present invention the lignocellulose containing material is pretreated prior to being subjected to the gas comprising chlorine dioxide. The pretreatment may be accomplished in the same equipment used for the gas comprising chlorine dioxide, yet, the pretreatment can also be performed in any suitable equipment located upstream the treatment with the delignifying gas. Suitably, the pretreatment includes various steaming and/or evacuation processes. The pretreatment is believed to open up the lattice structure of the lignocellulose containing material thereby improving the diffusion of the delignifying gas into the material.

The removal of lignin from lignocellulose containing material is conducted prior to a chemical pulping process. Any chemical pulping process known to the skilled artisan can be employed within the scope of the present invention exemplified by the sulphite, bisulphite, kraft (sulphate), soda, soda anthraquinone (soda AQ) or organosolv process or modifications and/or combinations thereof. Suitable chemical pulping processes are further disclosed in Rydholm, Pulping Processes, Interscience Publisher and Ullman's Encyclopedia of Industrial Chemistry, $5^{th}$ Edition, Vol.A18, 1991, pages 568 and 569, which documents all are incorporated by reference.

According to a preferred embodiment of the present invention the treatment of the lignocellulose containing material with a delignifying gas comprising chlorine dioxide is carried out prior to a soda anthraquinone (soda AQ) pulping process. The cooking liquor in a soda AQ chemical pulping process is essentially free from sulphur containing compounds which are the predominant compounds causing malodorous compounds, i.e. sulphurous compounds. Accordingly, one further advantage with the present invention according to this embodiment is the minimisation of malodorous compounds.

The process may be operated in either batch or continuous mode.

Subsequent the process according to the present invention the obtained pulp may be delignified and bleached using any available technique such as totally chlorine free bleaching (TCF), elementary chlorine free bleaching (ECF) or bleaching sequences containing chlorine, although not preferred. The pulp can also be subjected to oxygen delignification subsequent the pulping process.

To further illustrate the invention the following examples are provided. All parts and percentages are by weight unless otherwise specified. Temperatures are in degrees Celsius.

EXAMPLE 1

Southern pine softwood chips obtained from a commercial pulp supplier were used. There was no special handling, separation or classification of the chips prior to the experiment.

A portion of the wood chips were cooked under Kraft pulping conditions with a fixed H factor to establish the baseline for the process. All the Kraft cooks were performed at 170° C. with a 22% effective alkali with a liquor to wood ratio of 4.55:1. The Kappa numbers of the untreated wood chips after cooking at various H factors are summarised in Table 1.

TABLE 1

| Untreated Wood Chips | | | |
|---|---|---|---|
| H Factor | 600 | 800 | 1200 |
| Kappa No. | 72 | 42 | 28.2 |

Samples of the wood chips were treated in a batch mode using chlorine dioxide containing gas at 2.7 volume % at a temperature of about 50° C. and a pressure of about 100 kPa at different time periods. Each batch was then cooked under Kraft pulping conditions at an H factor of 600. The resulting Kappa Numbers after cooking are shown in Table 2.

TABLE 2

| Kappa Number Results | | | |
|---|---|---|---|
| Batch | Treatment time [min] | Kappa After digestion | % Kappa Reduction |
| reference | 0 | 72 | — |
| 1 | 15 | 57 | 27.8 |
| 2 | 30 | 46 | 36.1 |
| 3 | 60 | 38 | 47.2 |

EXAMPLE 2

The procedure of example 1 was repeated with the difference that each batch was then cooked under Kraft pulping conditions at an H factor of 1200. The resulting Kappa Numbers after cooking are shown in Table 3.

TABLE 3

| Kappa Number Results | | | |
|---|---|---|---|
| Batch | Treatment time [min] | Kappa After Cook | % Kappa Reduction |
| reference | 0 | 28.2 | — |
| 1 | 15 | 27.9 | 1.1 |
| 2 | 30 | 25.4 | 9.9 |
| 3 | 60 | 24.4 | 13.5 |

EXAMPLE 3

A sample of the wood chips according to example 1 was treated in batch mode using chlorine dioxide gas at 5.5 volume % at a temperature of about 50° C. and a pressure of about 100 kPa for 30 minutes. The treated chips were then cooked under Kraft pulping conditions at an H factor of 600. The resulting Kappa Number after cooking was 38.

EXAMPLE 4

A sample of the wood chips was treated in batch mode using chlorine dioxide gas at 2.5 volume % at a temperature of about 50° C. and a pressure of about 100 kPa for 60 minutes. The treated chips were then cooked under Soda-Antraquinone conditions to an H factor of 1600. The resulting Kappa Number after cooking was equal to 37. Untreated chips cooked at an H-factor of 1600 under the same Soda-AQ conditions had a final Kappa Number of 64. Thus, a Kappa No. reduction of 42% of the pulp was obtained.

From the above examples it is evident that the kappa number after cooking was substantially lower at a constant H factor when the lignocellulose containing materials were pre-treated with chlorine dioxide containing gas prior to the cooking process.

This means also that a given kappa number after cooking can be achieved at a lower H factor (less dosage of inter alia cooking chemicals) when using lignocellulose containing materials that have been pretreated with chlorine dioxide according to the invention as compared to untreated chips.

The invention is further illustrated by the following claims, which, however, do not limit the scope thereof.

What is claimed is:

1. A process for the removal of lignin from lignocellulose containing material comprising treating the lignocellulose containing material prior to a chemical pulping process with a delignifying gas comprising chlorine dioxide, wherein the lignocellulose containing material is essentially free from a surrounding solution.

2. A process according to claim 1, wherein the chemical pulping process is a kraft, a soda anthraquinone (soda-AQ) or sulfite pulping process.

3. A process according to claim 1, wherein the charge of chlorine dioxide is from about 0.5 kg active $Cl_2$ per tonne oven dry lignocellulose containing material up to about 300 kg active $Cl_2$ per tonne oven dry lignocellulose containing material.

4. A process according to claim 3, wherein the charge of chlorine dioxide is from about 2 kg active $Cl_2$ per tonne oven dry lignocellulose containing material up to 100 kg active $Cl_2$ per tonne oven dry lignocellulose containing material.

5. A process according to claim 1, wherein the concentration of chlorine dioxide is from about 0.05 up to about 100% by volume.

6. A process according to claim 5, wherein the concentration of chlorine dioxide is from about 0.05 up to about 50% by volume.

7. A process according to claim 1, wherein the pressure during the treatment with the delignifying gas is from about 10 kPa up to about 500 kPa.

8. A process according to claim 1, wherein the temperature during the treatment with the delignifying gas is from about 10 up to about 400° C.

9. A process according to claim 8, wherein the temperature is from about 15 up to about 200° C.

10. A process according to claim 1, wherein the lignocellulose containing material prior to the treatment with the delignifying gas is subjected to steaming and/or evacuation.

11. A process according to claim 1, wherein the treatment with the delignifying gas is operated in batch or continuous mode.

* * * * *